US010287070B2

(12) United States Patent
Tabone

(10) Patent No.: US 10,287,070 B2
(45) Date of Patent: May 14, 2019

(54) CONTAINER BASE AND LID WITH PLANAR AREA FOR FLAT APPLICATION OF ADHESIVE MEMBRANE

(71) Applicant: Maurice Joseph Paul Tabone, Moorebank (AU)

(72) Inventor: Maurice Joseph Paul Tabone, Moorebank (AU)

( * ) Notice: Subject to any disclaimer, the term of this patent is extended or adjusted under 35 U.S.C. 154(b) by 41 days.

(21) Appl. No.: 15/656,623

(22) Filed: Jul. 21, 2017

(65) Prior Publication Data

US 2017/0341833 A1 Nov. 30, 2017

Related U.S. Application Data

(63) Continuation of application No. 12/449,556, filed as application No. PCT/AU2008/000173 on Feb. 12, 2008, now abandoned.

(51) Int. Cl.

| | |
|---|---|
| ***B65D 55/06*** | (2006.01) |
| ***B65D 43/02*** | (2006.01) |
| ***B65D 43/16*** | (2006.01) |

(52) U.S. Cl.

CPC ..... *B65D 55/06* (2013.01); *B65D 43/0202* (2013.01); *B65D 43/161* (2013.01); *B65D 43/162* (2013.01); *B65D 2203/02* (2013.01)

(58) Field of Classification Search

CPC .. B65D 55/0818; B65D 55/06; B65D 43/162; B65D 43/163; B65D 2203/02; B65D 2251/1016; B65D 23/36; B65D 77/36; B65D 2102/0007

See application file for complete search history.

(56) References Cited

U.S. PATENT DOCUMENTS

| | | | | |
|---|---|---|---|---|
| 4,312,451 | A | 1/1982 | Forbes, Jr. | |
| 4,570,818 | A * | 2/1986 | Borst | B65D 25/36 206/459.5 |
| 5,018,622 | A * | 5/1991 | Hartley | B65D 25/22 206/461 |
| 5,405,009 | A | 4/1995 | Hackenbracht | |
| 5,636,737 | A | 6/1997 | Marsilio | |

(Continued)

FOREIGN PATENT DOCUMENTS

| | | |
|---|---|---|
| AU | 2003234951 | 6/2004 |
| EP | 1558504 | 8/2005 |

(Continued)

OTHER PUBLICATIONS

International Preliminary Report on Patentability (IPRP), PCT/AU2008/000173 (WO2008098288), dated Apr. 30, 2009.

*Primary Examiner* — Andrew T Kirsch

(74) *Attorney, Agent, or Firm* — Miller Nash Graham & Dunn LLP

(57) ABSTRACT

The invention provides a container (40) of the type to hold fresh food or produce. Container (40) has a base (42) and a lid (44) moveable with respect to the base (42) between an open position and a closed position. The lid (44) has a planar area (54). The base has a second planar area (56). In the closed position, the first planar (54) and the second planar area (56) include a substantially flat area suitable for receipt of an adhesive membrane, such as a self-adhesive label. The substantially flat area includes an edge (55) of the first planar area (54) and at least part of the second planar area (56).

25 Claims, 7 Drawing Sheets

(56) References Cited

U.S. PATENT DOCUMENTS

| | | | |
|---|---|---|---|
| 5,893,587 | A | 4/1999 | Wong |
| 6,352,170 | B1 | 3/2002 | Brown et al. |
| 6,540,074 | B1 | 4/2003 | Sankey et al. |
| 2004/0226955 | A1 | 11/2004 | Frantz |

FOREIGN PATENT DOCUMENTS

| | | |
|---|---|---|
| FR | 2349182 | 11/1977 |
| WO | 2008098288 | 8/2008 |

* cited by examiner

CONTAINER BASE AND LID WITH PLANAR AREA FOR FLAT APPLICATION OF ADHESIVE MEMBRANE

RELATED APPLICATIONS

This application is a continuation of U.S. patent application Ser. No. 12/449,556, filed Aug. 12, 2009, which is a U.S. National Phase entry under 35 U.S.C. § 371 of International Application No. PCT/AU2008/000173, filed Feb. 12, 2008, which claims the benefit under 35 U.S.C. § 119(a) of Australian Application No. 2007902246, filed Apr. 30, 2007, and Australian Application No. 2007900654, filed Feb. 12, 2007.

FIELD OF THE INVENTION

This invention relates to containers. In particular, this invention relates to containers intended to hold fresh food or produce, although the scope of the invention is not limited to this area. The invention is especially concerned with containers in a form which can facilitate application of labels, such as tamper evident labels.

Priority is claimed of Australian Patent Application Nos 2007900654 and 2007902246, the contents of the specifications of which are incorporated herein by reference.

BACKGROUND OF THE INVENTION

Thermoformed containers suitable for holding fresh food or produce are in common use. Traditionally, these have consisted of a base with a lid, the lid being hinged to the base or separate therefrom. In order to secure the lid to the base, these known containers require one or more labels to be adhered to both the lid and the base in a "wrap around" fashion. In high output operations, there is a problem in applying a "wrap around" (non-flat) label because automated equipment is generally designed for flat label application.

In addition, labels applied to containers of this type often carry a barcode, usually along with other information. There can be problems in scanning barcodes on non-flat labels. Consequently, from this point of view, a flat label would be preferred.

It is an object of the present invention, at least in some embodiments, to provide a container configuration which permits flat application of labels.

More recently, a dual hinged lid container has been devised. Reference is made to Australian patent No 2003234951. The specification of this patent discloses a container having a lid provided in two parts, each part being hinged to the base. When both lids are closed, there is available a generally flat area across the lid edges in the center of the container top to permit a flat label to be applied. The flat label so applied can act as a tamper evident seal.

While this prior art dual hinged lidded container can work admirably in many applications, there are instances where it is undesirable to apply a label across a join in the center of a container lid in this manner. For example, the label may obstruct a consumer's view of contents of the container, especially where there is a relatively high label-to-lid area ratio. As another example, on larger containers, a regular sized label may prove inadequate to give a tamper evident seal. If the size of the label were to be increased, this would add to label cost and may prove uneconomical. In other instances, it may be desirable to provide a container with increased security.

It is an object of the present invention, at least in some embodiments, to alleviate some or all of these concerns or, at the least, to provide a useful alternative which is appropriate for containers of different shapes and sizes.

DISCLOSURE OF THE INVENTION

Accordingly, the present invention provides a container having a base and a lid moveable with respect to the base between an open position and a closed position, the lid having a first planar area and the base having a second planar area, wherein, in the closed position, the first and second planar areas include a substantially flat area suitable for receipt of an adhesive membrane, the substantially flat area including an edge of the first planar area and at least part of the second planar area.

The container of the invention may be made of any suitable material but preferably is a thermoformed, relatively thin plastic material, as is presently known in the art. Examples of suitable thermoformable plastic material are polyvinyl chloride (PVC), polyethylene terephthalate (PET), polypropylene, polylactide (PLA) and biaxially oriented polystyrene (BOPS). The container may be of any desirable shape. Currently, most popular containers of this type are square or rectangular in cross section and these are encompassed by the present invention, along with other shapes.

The base preferably includes a floor and upwardly extending side walls. Preferably, all or at least one of the side walls end at a rim which, in some embodiments, may include the second planar area. If desired, the rim may include means for supporting the container during the selling process. For example, the rim may include a hang sell hole for "off-shelf" display.

The lid or the base may include ventilation holes, ribs or arches or any other modifications suited to intended contents and/or conditions of sale.

The base and upstanding side walls may define an opening which, in use, is horizontal. However, other variations are possible. For example, the base may define an opening which, in use, is vertical and intended to be closed by a lid in a vertical orientation in use.

The lid is moveable with respect to the base between an open position and a closed position. The lid may be hinged or otherwise attached to the base in any suitable manner. Alternately, the lid may be separate from the base, in which case it may be desirable to have two or more first planar areas on the lid and correspondingly two or more second planar areas on the base if tamper evidence is required.

The lid may be generally flat or it may include shaped portions (such as one or more domes, ribs or arches) in addition to the first planar area. Optionally, the lid may include one or more recessed portions which may be useful for storing items which a consumer may require once the container has been opened. Such items may include cutlery, dressings and condiments.

The lid may be of known type, for example an "inside fitting" or an "outside fitting" lid in relation to the base when closed.

The lid may be a single lid or may be a multi-part lid. For example, the invention is applicable to the type of dual-lidded container in Australian patent No. 2003234951. An embodiment is shown in the drawings, below. The lid may have more than two parts.

The lid and/or the base may include any suitable mechanical locking mechanisms, such as one or more projections, each receivable in a recess with an interference-type fit. These may be located on surfaces which, in use, are horizontal or vertical, for example. Another example of a locking mechanism is a channel style lock.

The first planar area is on the lid and preferably is greater than 5 cm2. The first planar area is preferably located adjacent an edge of the lid since, when a label or other adhesive membrane is applied, at least part of the purpose is to secure the lid to the base. In a preferred embodiment, the first planar area is located opposite a hinged edge of the lid, when the lid is hinged to be base. However, it is to be understood that the invention is not limited to this. The first planar area may be located adjacent any edge of the lid or in any other desired location. For example, the first planar area may be located on a side of the lid (approximately vertical in use.)

The first planar area may be generally parallel to a floor in the base. However, other configurations are possible. For example, the first planar area may be disposed at an angle to some or all of the remainder of the lid. An example is illustrated in the drawings, below.

The second planar area is on the base. This may take any suitable form and many variations are possible. By way of example, the second planar area may be located on a rim for the base or on an extension thereof, optionally inclined at an angle to the rim. The lid may be contoured for a snug fit with the second planar area.

The substantially flat area suitable for receipt of an adhesive membrane includes an edge of the first planar area and at least part of the second planar area. It is intended, or course, that the adhesive membrane (preferably an adhesive label) may be applied to the substantially flat area, connecting the lid and the base in the area of the edge of the first planar area included in the substantially flat area. The first and second planar areas may be adjacent or they may partially overlap. In one view, they may be regarded as generally coplanar, although, strictly speaking, where there is a simple overlap there will be a small step from the first planar area to the second planar area.

The edge of the first planar area may simply abut at least part of the second planar area. In another embodiment, the edge of the first planar area may form a chamfered abutment with at least part of the second planar area. In yet another embodiment, an edge of the first planar area surrounds the second planar area.

The substantially flat area is preferably located at an opposite side of the container to the hinge, or opposite each hinge when there is more than one. However, the invention is not limited to this configuration.

It will be appreciated that when the lid is in the closed position, the substantially flat area is preferably suitable for application of an adhesive membrane, such as a self-adhesive label applied by an automated applicator in a generally flat fashion.

While the adhesive membrane is preferably a self-adhesive label, it may also take other forms. For example, it may be a heat sealable lidding film of plastic, foil or other sheet material.

If desired, the adhesive membrane may have a perforation or other area of weakness locatable at or adjacent the edge of the first planar area within the substantially flat area. The purpose of this is to simplify opening of the container by the consumer.

If there are two or more first planar areas and second planar areas, the adhesive membrane may be applied to all of these, or some of these, or to one first planar area and one second planar area only.

If desired, the container of the invention may be designed so as to be nestable or stackable with identical or similar containers.

BRIEF DESCRIPTION OF THE DRAWINGS

The invention will now be described in relation to certain non-limiting examples thereof in the accompanying drawings, in which.

DETAILED DESCRIPTION OF THE DRAWINGS

Figure 1:
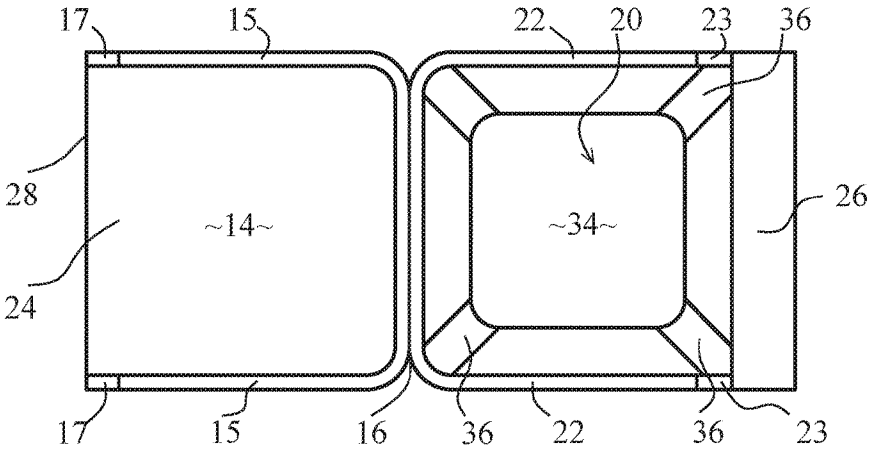
FIG. 1 is a plan view of a first embodiment of container according to the invention, showing a lid, hinged to the base in the open position.
Figure 2:
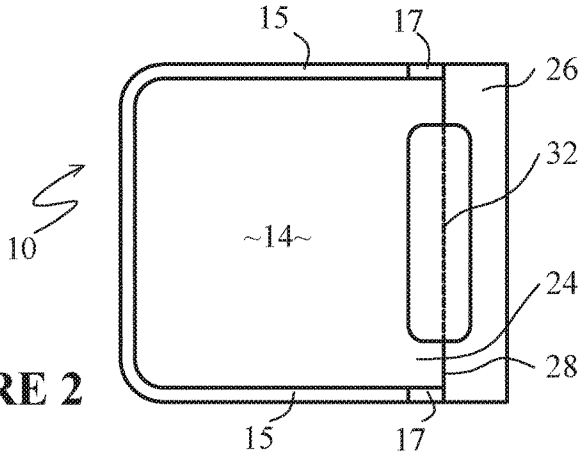
FIG. 2 corresponds to the embodiment in FIG. 1, but showing the lid in the closed position.
Figure 3:
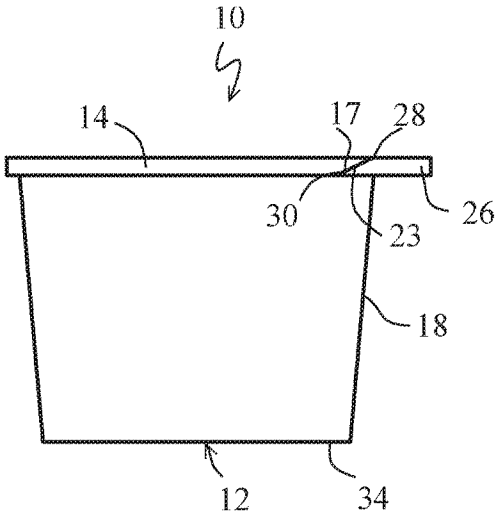
FIG. 3 is a side elevation of the embodiment of FIGS. 1 and 2, with the lid in the closed position.
Figure 4:
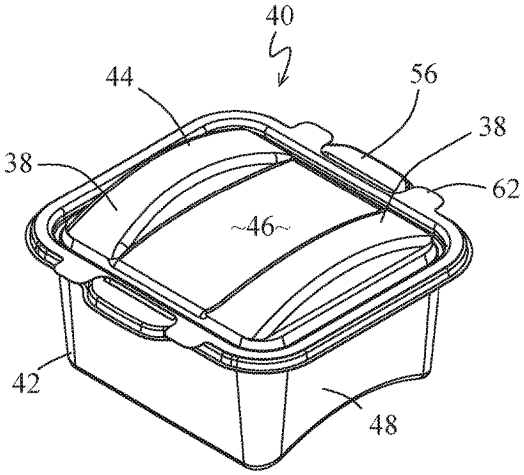
FIG. 4 is a perspective view of a second embodiment of container according to the invention, having a lid separate from the base.

Referring first to FIGS. 1, 2 and 3, the first embodiment of the container of the invention, designated generally as 10, has a base 12 and a lid 14, hinged to base 12 at hinge 16. Rims 15 have ramp portions 17.

Base 12 has upwardly extending sidewalls 18 defining an opening 20 through which products are inserted into container 10 before lid 14 is closed. At the top end of walls 18 of base 12 are rims 22 (refer FIG. 1), each of which has a ran1p portion 23.

Lid 14 in this embodiment has a first planar area 24 which, in this embodiment, comprises virtually the whole of lid 14. The second planar area is formed by rim portion 26 which, as can be seen in FIG. 1, is wider than rims 22. Ramp portion 23 is inclined upwardly from rim 22 to rim 26.

In the closed position, illustrated in FIG. 2, first planar area 24 has mated with second planar area—rim 26—to form a substantially flat area in which edge 28 of lid 14 has mated with rim 26 of base 12, chamfer 30 being formed between them, using ramp portion 23. Adhesive label 32 is shown in place in FIG. 2.

As can be seen in FIG. 1, sidewalls 18 of base 12 are tapered towards floor 34, comers 36 being rounded as illustrated.

Margin 15 on lid 14 can include locking means to lock lid 14 to base 12 via rims 22.

Turning now to the second embodiment illustrated in FIGS. 4 to 9, the container of the invention, designated generally as 40, has a base 42 and a separate lid 44, with upwardly extending side walls 48 defining an opening 50 through which product may be inserted before lid 44 is closed. Base 42 has a rim 52 with a pair of enlarged portions 56, comprising in this embodiment second planar areas.

Lid 44 has a first planar area 54 defined by ribs 38 and edges 55.

A single label (not shown) can extend over the whole of first planar area 54 and both second planar areas 56. Alternately, two separate labels may be used, the first covering part of first planar area 54 and one of the adjacent second planar areas 56, while the over covers part of first planar area 54 and the adjacent second planar area 56, leaving free central portion 46 of lid 44.

Figure 6:
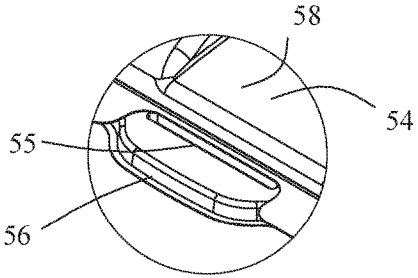
FIG. 6 is a detail of the circled portion of FIG. 4.
Figure 5:
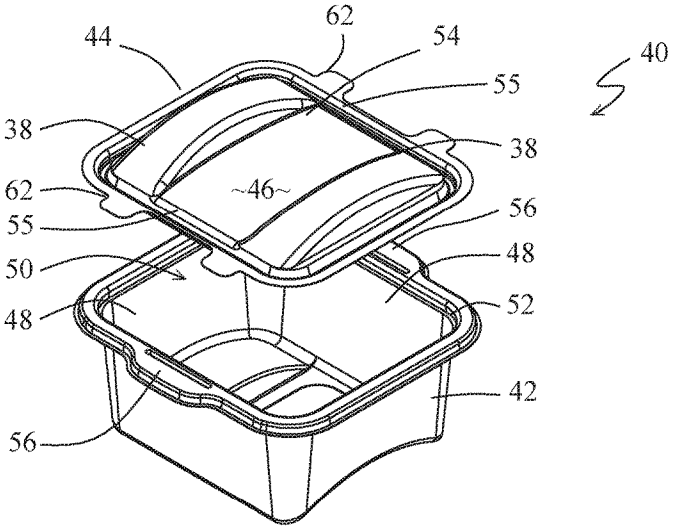
FIG. 5 is an exploded view of the embodiment in FIG. 4.
Figure 7:
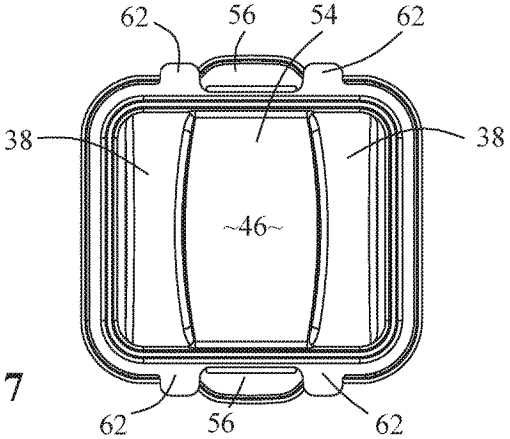
FIG. 7 is a top plan view of the embodiment of FIG. 4.

As shown in FIG. 6, each of second planar areas 56 may include an aperture or recess 58. A sharp object may be inserted through a label (not shown) covering first planar area 54, second planar area 56 and aperture 58, to tear the label through aperture 58, to assist in removing lid 44 from base 42.

In this embodiment, lid 44 also includes removal tabs 62, to assist in removing lid 44 from base 42.

Figure 8:
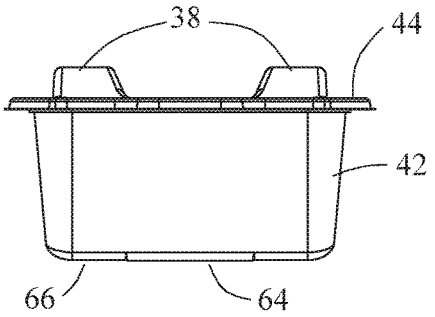
FIG. 8 is a front elevation of the embodiment of FIG. 4.
Figure 9:
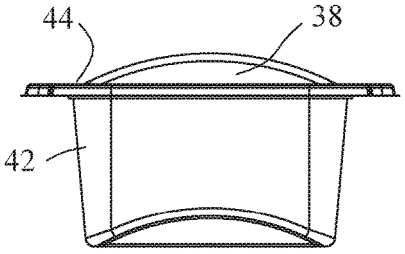
FIG. 9 is a side elevation of the embodiment of FIG. 4.

Container 40 may include vents (not shown) and depression 64 in floor 66 of base 42, as desired (refer FIG. 8). Container 40 may also include one or more recessed portions in lid 44. These may be included in central portion 46 or in another desired location. It is preferred that any such recessed portion is sealed by a label.

Figure 10:
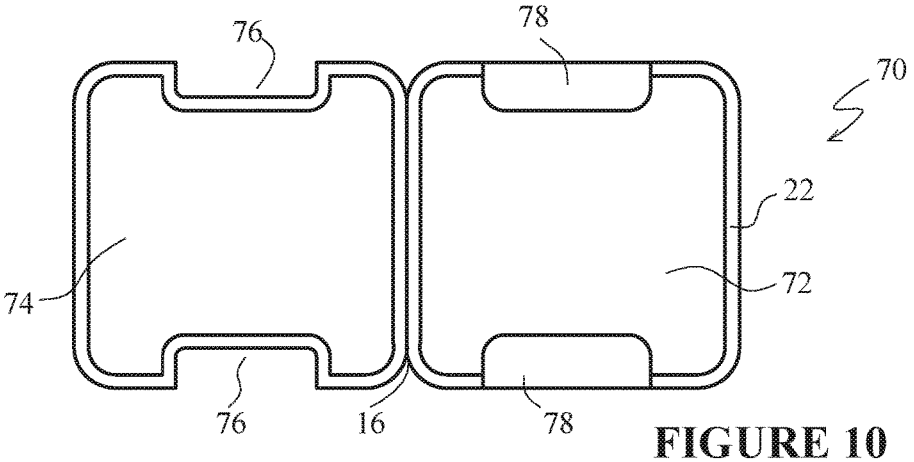
FIG. 10 is a top plan view of a further embodiment in the open position.
Figure 11:
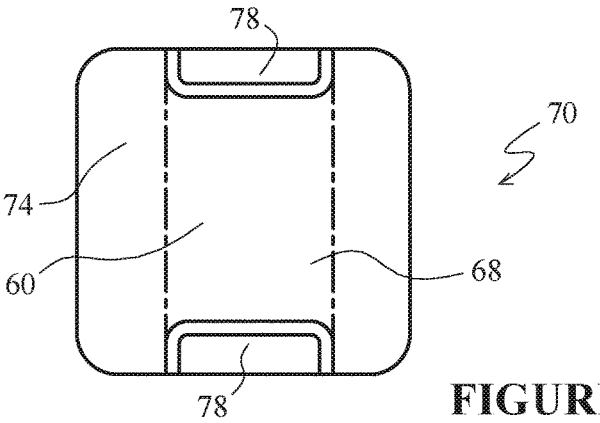
FIG. 11 is a top plan view of the embodiment of FIG. 10, showing the lid in the closed position.

A third embodiment is shown in FIGS. 10 and 11, where container 70 has base 72 hinged to lid 74 at 16. Lid 74 is cut away at 76 and base 72 has flat portions 78. As can be seen in FIG. 11, when lid 74 is closed on base 72, cut aways 76 leave flat portions 78 exposed. When a label 60, shown in dotted outline in FIG. 11, is placed over first planar area 68 of lid 74 and over flat portion 78 (second planar areas) of base 72, lid 74 is effectively sealed to base 72. Flat portions 78 stand proud of rim 22, so that when exposed by cut-outs 76 of lid 74, first planar area 68 is substantially co-planar with flat portions 78.

Figure 13:
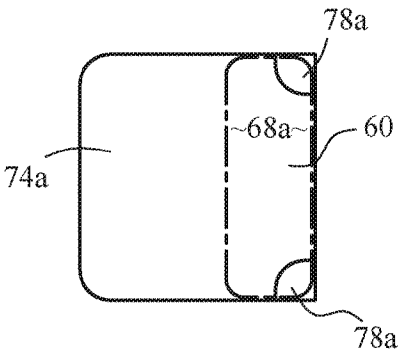
FIG. 13 is a top plan view of the embodiment of FIG. 12 in the closed position.
Figure 12:
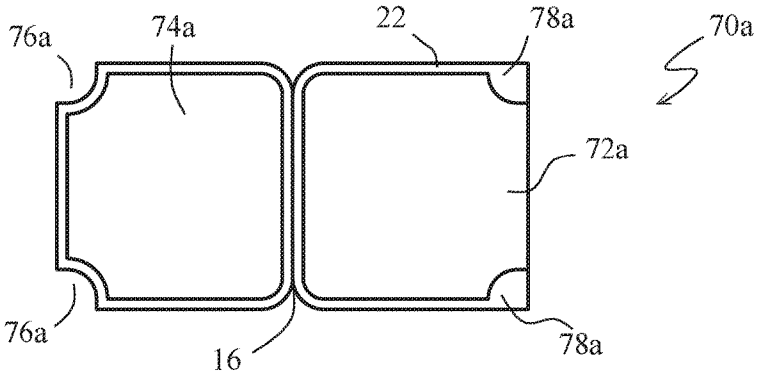
FIG. 12 is a top plan view of a further embodiment in the open position.

The next embodiment in FIGS. 12 and 13 is similar to that in FIGS. 10 and 11 and the same numbers have been used to indicate the same or similar parts, with the addition of the letter "a". Whereas in the FIGS. 10 and 11 embodiment the cut-away portions 76 on lid 74 were centered in an edge of lid 74, in the FIGS. 12 and 13 embodiment cut-away portions **76*a* are located in two opposite corners of lid 74*a***.

Similarly, flat portions **78*a* are located at comers of base 72*a***.

As was the case with the previous embodiment, when lid **74*a* is closed on base 72*a*, flat portions 78*a* are substantially co-planar with first planar area 68*a***.

Figure 15:
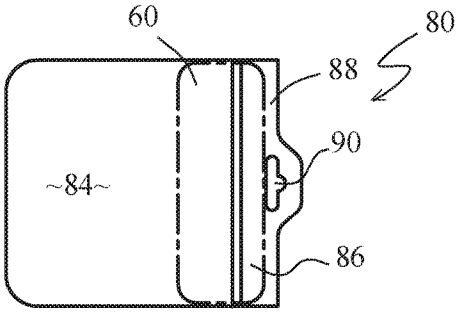
FIG. 15 is a top plan view of the embodiment of FIG. 14 in the closed position.
Figure 14:
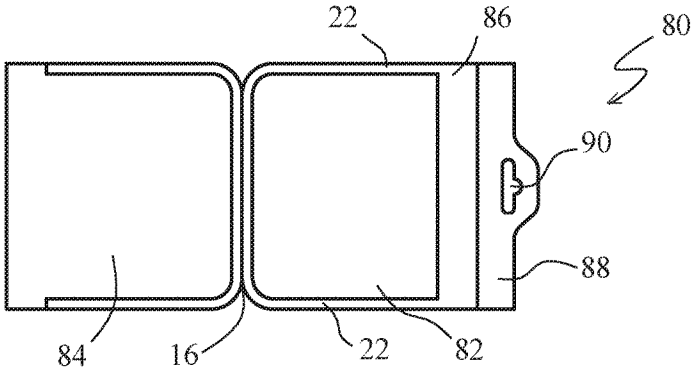
FIG. 14 is a top plan view of a further embodiment in the open position.

The next embodiment shown in FIGS. 14 and 15 shows container 80 having base 82 and lid 84. Base 82 has narrow rims 22 and expanded rim 86. Expanded rim 86 includes further portion 88 with hang sell hole 90, to enable container 80 to be displayed on a hanger.

Expanded rim 86 is designed so that, when lid 84 is closed on container 82, expanded rim 86 is substantially co-planar with lid 84, which in this embodiment comprises the first planar area.

As can be seen in FIG. 15, label 60 can be affixed to cover the right-hand side of lid 84 and expanded rim 86.

Figure 16:
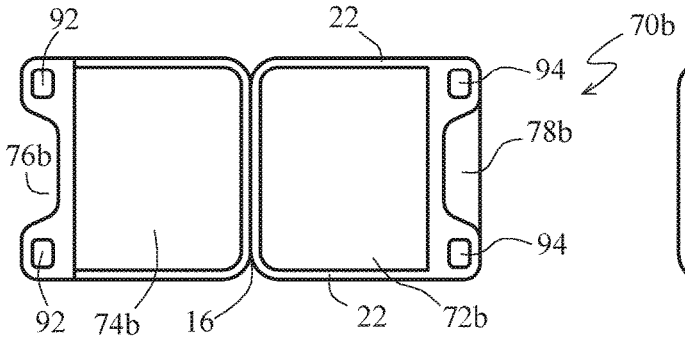
FIG. 16 is a top plan view of a further embodiment in the open position.
Figure 17:
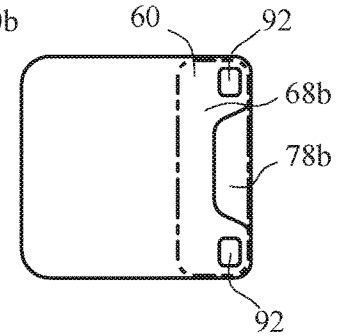
FIG. 17 is a top plan view of the embodiment of FIG. 16 in the closed position.

The embodiment in FIGS. 16 and 17 is similar to that shown in FIGS. 10 and 11 and 12 and 13. The same labels will be used to designate the same or similar parts, with the addition of the letter "b".

Container **70*b* has base 72*b* and lid 74*b*, hinged at 16. Cut-away 76*b* on lid 74*b* is designed to expose flat portion 78*b* on base 72*b* in the closed position (FIG. 17). Flat portion 78*b* stands proud of rim 22 so that first planar area 68*b* is substantially co-planar with flat portion 78*b***.

This embodiment includes lock lugs 92 designed for a friction fit into lock recesses 94 on base **72*b*. As can be seen from FIG. 17, when label 60 is affixed, it covers not only first planar area 68*b* and flat portion 78*b* but also lock lugs 92**.

The embodiments in FIGS. 18 to 21 illustrate how the first and second planar areas may be disposed at an angle to the lid and to a rim on the base.

Figure 18:
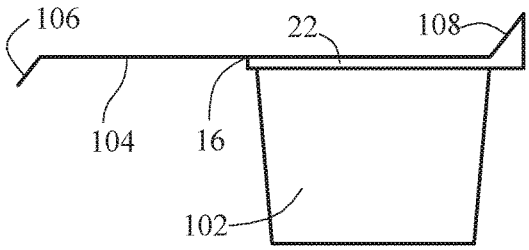
FIG. 18 is a side elevation of a further embodiment, where the first and second planar areas are at an angle to the base and lid, the lid being in the open position in this Figure.
Figure 19:
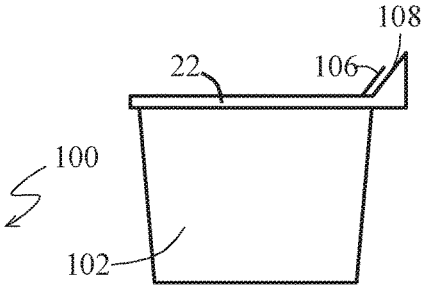
FIG. 19 shows the embodiment of FIG. 18, with the lid in the closed position.

Referring first to FIGS. 18 and 19, container 100 has lid 104 hinged to base 102 at 16. Lid 104 includes extension 106 which, in use, is inclined upwardly at an obtuse angle from lid 104.

Base 102 has rim 22 which has extension 108, in use inclined at an obtuse angle from rim 22.

In the closed position, extension 106 is designed to mate with extension 108. Extension 106 has one or more cut-outs, similar to those already illustrated in FIGS. 10 to 13 or 16 and 17, so that a flat label 60 applied to extension 106 will bind extension 106 to extension 108, exposed by the cut-out or cut-outs.

Figure 20:
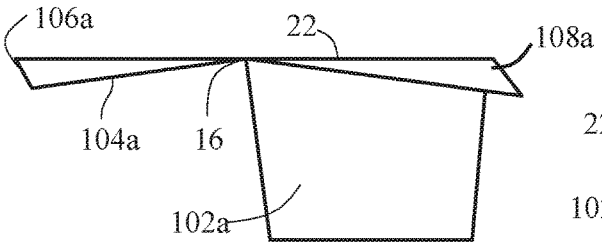
FIG. 20 is a side elevation of a further embodiment where the first and second planar areas are at an angle to the lid and base, showing the open position.
Figure 21:
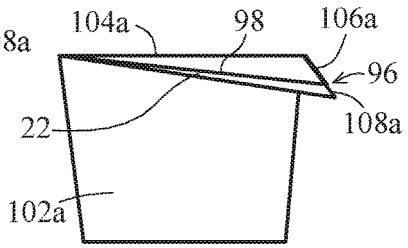
FIG. 21 shows the embodiment in FIG. 20 in the closed position.

The embodiment in FIGS. 20 and 21 is a variation of that in FIGS. 18 and 19 and the same labels will be used, with the addition of the letter "a". In this embodiment, lid **104*a* ends in flat portion 106*a*. Rim 22 on base 102*a* has a downwardly extending extension 108*a***.

In the closed position, extension **106*a* mates with extension 108*a* along margin 98 to provide a substantially co-planar surface 96 on which a label 60 (not shown) may be placed to seal lid 104*a* to base 102*a***.

It will be apparent to one skilled in the art that the embodiments in FIGS. 18 to 21 may be adapted to containers with separate lids. In that case, it is preferred that there are two extensions 106 (or **106*a*) and two extensions 108 (or 108*a***).

Figure 23:
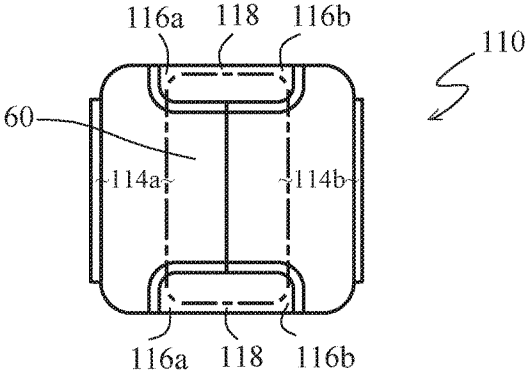
FIG. 23 shows the FIG. 22 embodiment with the lid parts in the closed position.
Figure 22:
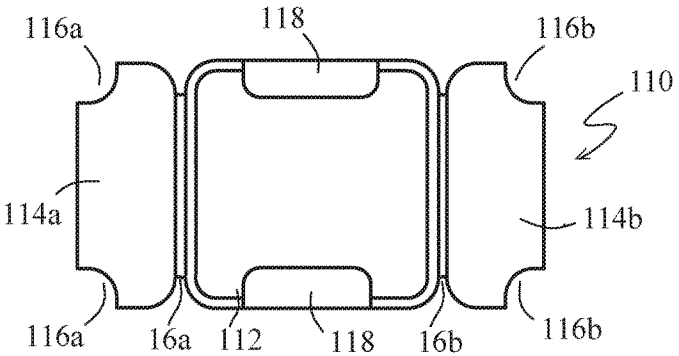
FIG. 22 is a top plan view of a further embodiment wherein the lid is in more than one part, showing the lid parts in the open position.

Reference is now made to the embodiment in FIGS. 22 and 23. In this embodiment, container 110 has base 112 as shown in FIG. 22. However, the lid is in two parts, **114*a* and 114*b*. Lid part 114*a* is hinged to base 112 at 16*a* while lid part 114*b* is hinged to base 112 at hinge 16*b***.

Each of lid parts 114*a* and 114*b* has a pair of cut-aways, 116*a* and 116*b*. When lid parts 114*a* and 114*b* are in the closed position as shown in FIG. 23, cut-aways 116*a* and 116*b* expose flat portions 118 on base 112. Lid parts 114*a* and 114*b* may meet or overlap in known manner, for example as described in Australian patent specification No 2003234951, the contents of which are incorporated herein by reference. Nevertheless, each of lid parts 114*a* and 114*b* provide a first planar area which is substantially co-planar with flat portion 118 on base 112. In this way, when lid parts 114*a* and 114*b* are in the closed position, label 60 can be applied on the substantially flat area so provided.

Figure 25:
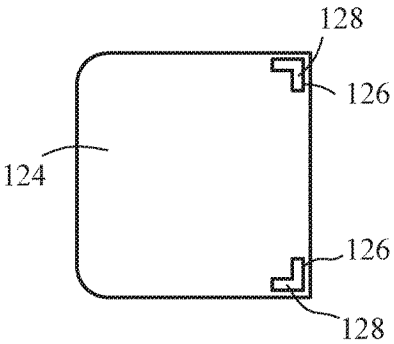
FIG. 25 shows the FIG. 24 embodiment in the closed position.
Figure 24:
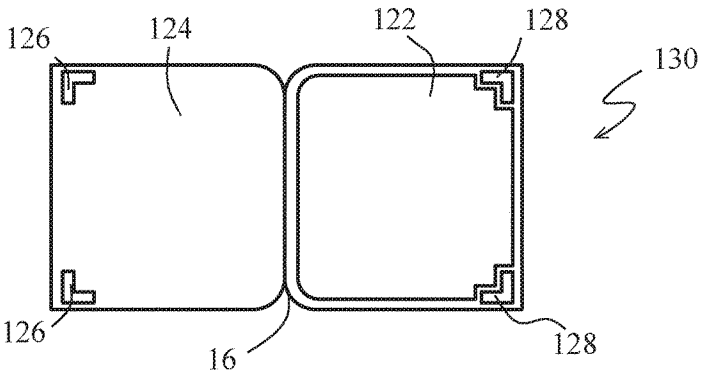
FIG. 24 is a top plan view of a further embodiment, showing the open position.

Referring now the embodiment in FIGS. 24 and 25, container 130 has base 122 hinged to lid 124 at hinge 16. Lid 124 has diecut holes 126. Lid 124 is generally flat to provide the first planar area.

Base 122 has formed sections 128, the top, flat part of which comprise the second planar areas. As can be seen by FIG. 25, in the closed position formed sections 128 mate with diecut holes 126 to form a substantially flat surface. A label (not shown) may be applied to cover both formed sections 128 and the intervening part of lid 124. Alternately, separate labels may be applied.

Figure 26:
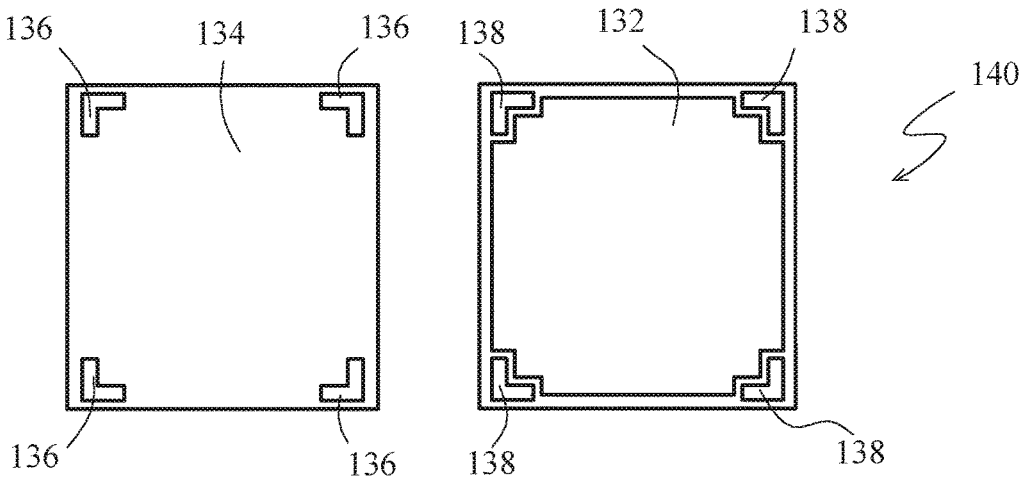
FIG. 26 shows yet a further embodiment, being a top plan view in the open position.
Figure 27:
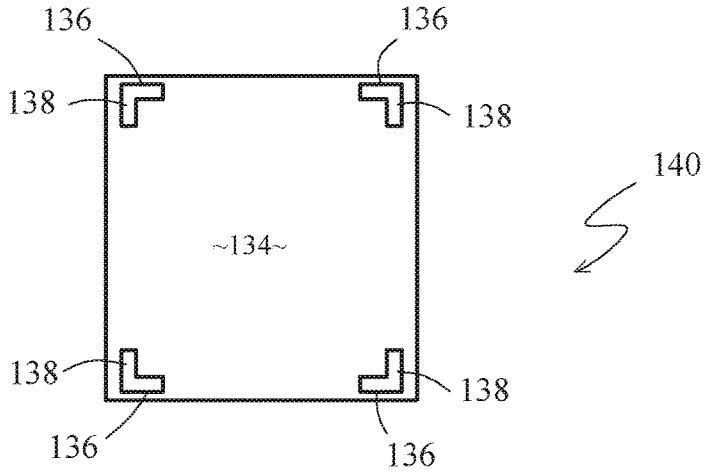
FIG. 27 shows the FIG. 26 embodiment in the closed position.

The embodiment in FIGS. 26 to 27 is similar to that in FIGS. 24 to 25; however, in container 140 in FIGS. 26 to 27, base 132 is separate from lid 134. In addition, there are four diecut holes 136 and correspondingly four. formed sections 138. Like the embodiment in FIGS. 24 and 25, when lid 134 which is of the "outside fitting" type, is placed on base 132, sections 138 protrude into diecut holes 136 to provide a substantially flat area for label application.

It will be appreciated from the various embodiments described above that the container of the invention can be produced in a wide number of forms and that, in addition, a single form may be suitable for application of different types of labels. Lids may be hinged or separate.

Lids may be substantially flat or they may be shaped, with ridges, ribs, domes as non-limiting examples of shaping. Especially in the case of substantially flat lids, these may be designed to mate with the base so that the second planar area or areas can appear on, for example, opposing sides of the lid, opposing comers of the lid or on one side of the lid, opposite the hinge. In the case of a lid which is a dual lid, with two hinges, the second planar areas may be on two opposing sides (viewing the closed lid in plain view), or on four comers, for example.

In the case of a separate lid, once again viewing the container in plain view in the closed position, the second planar areas may be in each of four comers, on two opposing sides, on two diagonal comers, around all four sides or separately on each of four sides. These are a selection only of possible combinations. Others will be apparent to one skilled in the art.

INDUSTRIAL APPLICABILITY

The container of the invention can be adapted to any currently known container design, whether having a single lid or a multi-part lid. The invention allows for manual or high speed automatic closure and flat, self-adhesive label application providing tamper evidence, while at the same time employing a minimum number of moving parts.

The container of the invention can offer important tamper evidence capabilities while maintaining minimal obstruction of vision through the container lid. For certain applications, the container of the invention will also allow alternate graphic methods to be successfully used, such as pre-printing, branding and nutritional information onto the lid area, thus reducing label requirements to a smaller, basic tamper evident label only.

The invention claimed is:

1. A container comprising an inside, a lid and a base moveable with respect to each other between, an open position and, a closed position, the closed position at least substantially enclosing the inside;

the lid comprising;

a lid shape suitable for at least partially enclosing the inside of the container when the container is in the closed position and, at least one first surface portion;

the base comprising:

an internal cavity having an opening suitable for receipt of contents into the internal cavity;

at least one sidewall comprising an internal surface with respect to the internal cavity;

wherein, when the container is in the open position and the lid is removed from the base, the base further comprises, a maximum potential internal base volume defined within inner extremities of the base and at least partially defined by one of, the internal surface of the at least one sidewall, the opening and the internal cavity;

at least one flange portion extended from the base, a flange portion comprising a second surface portion wherein the second surface portion comprises a continuation of the internal surface of the at least one sidewall;

wherein, when the container is in the closed position, the lid is disposed at least partially beyond the opening of the internal cavity of the base in a generally outward direction with respect to the internal cavity wherein the lid is suitable to contain at least some of any contents which may extend outwardly from the internal cavity and at least partially beyond the opening to an area outside of the maximum potential internal base volume and, wherein, the container comprises a total internal volume, the total internal volume being at least partially defined within the inside of the container in the closed position by a substantially internal facing surface of the lid, the total internal volume being no less in volume than the maximum potential internal base volume alone;

wherein each first surface portion and each second surface portion of the container in the closed position are disposed at least substantially external with respect to the total internal volume and wherein, in the closed position, the at least one first surface portion and at least one second surface portion are disposed at least substantially coplanar with respect to each other and wherein, together, comprise a surface configuration suitable to be overlayed by a membrane layer wherein, the membrane layer continues beyond the surface configuration in two substantially opposite directions to further overlay two immediately adjacent areas with respect to the surface configuration wherein, one of the two immediately adjacent areas is disposed on the at least one flange and the other of the two immediately adjacent areas is disposed on the lid and wherein, while overlaying the surface configuration and the two immediately adjacent areas, the membrane layer at least substantially contours to the underlying outer shape of the container and is substantially flat.

2. The container of claim 1 wherein the lid is comprised of a material comprising two opposing sides with respect to each other, each opposing side comprising a generally continuous surface wherein, the at least one first surface portion is disposed on the generally continuous surface of one of the two opposing sides and, wherein, the substantially internal facing surface of the lid is disposed on the generally continuous surface of the other opposing side.

3. The container of claim 2 wherein, each second surface portion is substantially outside of the largest inner perimeter of the opening of the base.

4. The container of claim 2 further comprising a hang sell aperture.

5. The container of claim 2 comprising at least one of, a rib, a depression and a recess.

6. The container of claim 2 wherein in the closed position, the at least one first surface portion of the lid is at least partially within the largest footprint of the opening of the base.

7. The container of claim 2 wherein, in the closed position, the at least one first surface portion and at least one second surface portion at least partially overlap.

8. The container of claim 2 wherein, the at least one first surface portion and at least one second surface portion are orientated so that the surface configuration is disposed at least substantially on a side of the container in the closed position when in use.

9. The container of claim 2 wherein in the closed position, the surface configuration is disposed at an oblique angle to the opening of the base.

10. The container of claim 2 wherein the container is configured to rest with the lid as the container's bottom, and the at least one first surface portion and at least one second surface portion are orientated so that the surface configuration is disposed at least substantially on the bottom of the container in the closed position when in use.

11. The container of claim 2 wherein, in the closed position, the at least one flange is comprised of a material comprising two opposing sides with respect to each other, each opposing side comprising a generally continuous surface wherein, at least one second surface portion is disposed on the generally continuous surface of one of the two opposing sides and, wherein, the generally continuous surface of the other opposing side is disposed at least substantially external with respect to the internal cavity.

12. The container of claim 2 wherein the lid is in two or more parts and each part is attached directly to the base by a hinge mechanism.

13. The container of claim 12 wherein each hinge mechanism is located on one edge of its respective lid part and the surface configuration does not include the edge.

14. The container of claim 1 wherein the surface configuration is substantially planar and at least partially within the largest footprint of the opening of the base.

15. The container of claim 1 comprising a plurality of surface configurations disposed on a plurality of substantially separate planes.

16. The container of claim 1 wherein the surface configuration comprises a circumferential dimension which is substantially less than each of, the largest internal perimeter of the opening of the base and the outermost boundary of the lid.

17. The container of claim 1 wherein in the closed position, the surface configuration is at least partially disposed at an oblique angle to the opening of the base.

18. The container of claim 1 further comprising means for mechanically attaching the lid to the base.

19. The container of claim 1 further comprising the membrane layer.

20. The container of claim 19 wherein, in the closed position, the overall size of the surface configuration together with the two immediately adjacent areas is, in combination, substantially less in area than the membrane layer.

21. The container of claim 19 wherein, in the closed position, the membrane layer is affixed to at least one part of the surface configuration.

22. The container of claim 19 wherein, the membrane layer creates a seal between the lid and the base of the container in the closed position by affixing to at least both, the at least one first surface portion and, at least one second surface portion.

23. The container of claim 22 wherein, when the lid is moved from the closed position to the open position, the seal is ruptured and, at least a portion of the membrane layer remains affixed to the lid.

24. The container of claim 1 wherein the at least one first surface portion is adjacent to at least one locating hole on the lid.

25. The container of claim 24 wherein, in the closed position, the at least one locating hole at least partially locates with at least one second surface portion to comprise the surface configuration.

* * * * *